United States Patent [19]

Boyd et al.

[11] Patent Number: 4,541,175

[45] Date of Patent: Sep. 17, 1985

[54] KNIFE

[76] Inventors: Francis M. Boyd, 1015 Girard St., San Francisco, Calif. 94134; Kenneth A. Fireman, 35 Kittredge Ter., San Francisco, Calif. 94118

[21] Appl. No.: 517,031

[22] Filed: Jul. 25, 1983

[51] Int. Cl.[4] ..... B26B 1/04

[52] U.S. Cl. ..... 30/161

[58] Field of Search ..... 30/159, 160, 161; 81/177 E; 145/64; 16/110 R, 110.5; 7/118–120

[56] References Cited

U.S. PATENT DOCUMENTS 900,339 10/1908 Woodruff ..... 7/119 X 3,942,249 3/1976 Poehlmann ..... 30/161 X 4,170,061 10/1979 Henry ..... 30/160

4,404,748 9/1983 Wiethoff ..... 30/161

*Primary Examiner*—Douglas D. Watts

*Attorney, Agent, or Firm*—Anthony A. O'Brien

[57] ABSTRACT

A foldable knife is disclosed as including a latching mechanism utilizing a non-circular non-arcuate multi-sided operator which positively locks the knife in its selected positions. The latching mechanism embodies a square shaped operator permitting the knife blade to be locked in each of a closed position, an intermediate position and an open position.

11 Claims, 9 Drawing Figures

FIG. 1
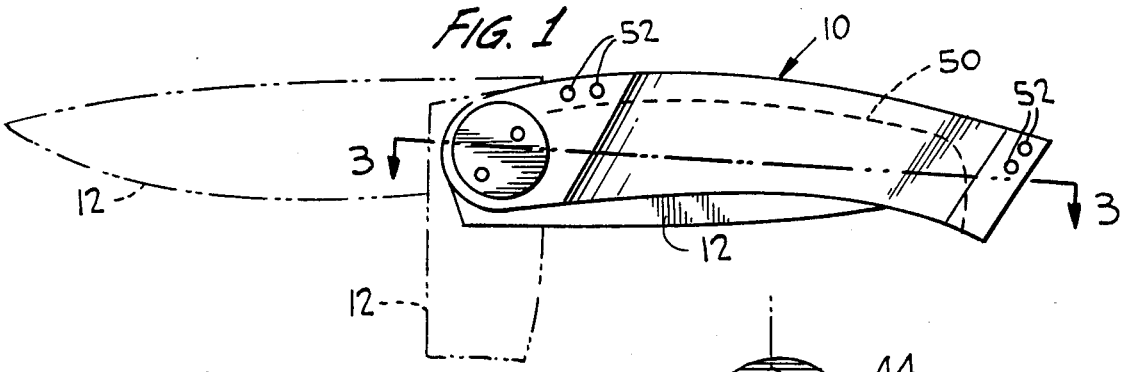
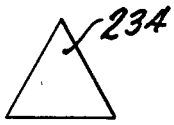
FIG. 9
FIG. 2
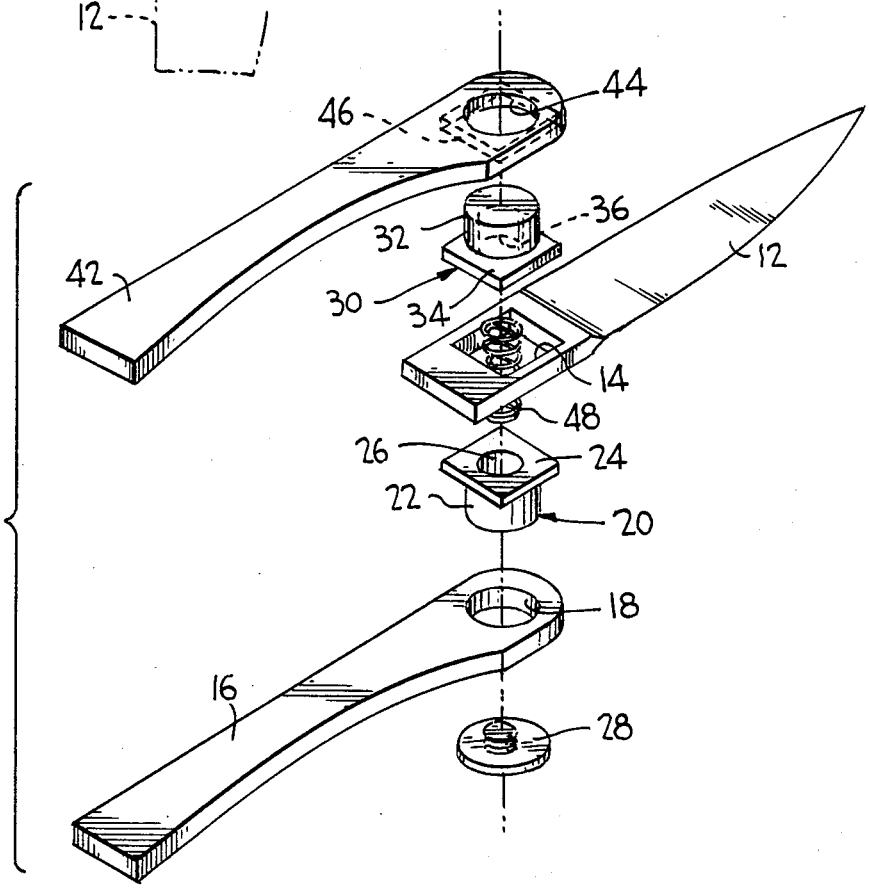
FIG. 3
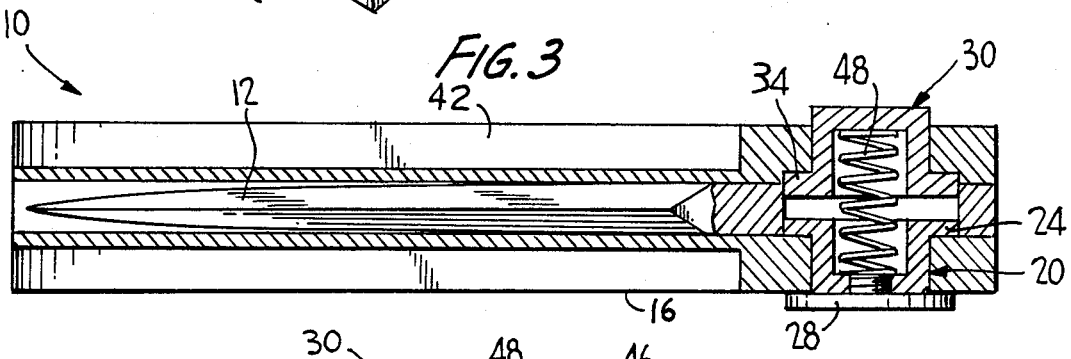
FIG. 4
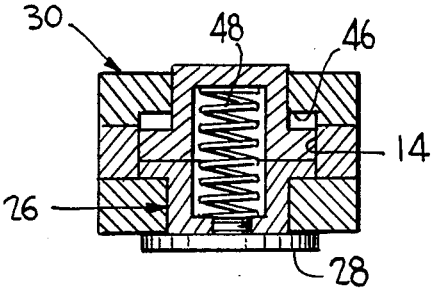

FIG. 5
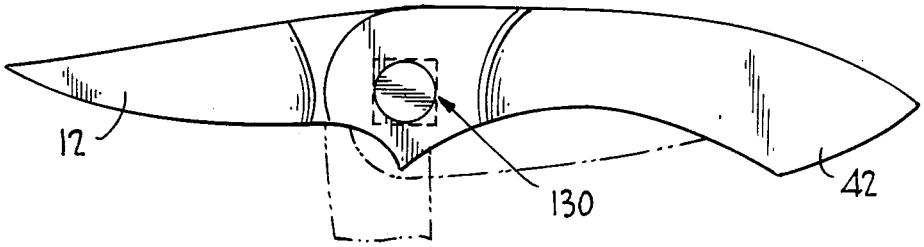
FIG. 6
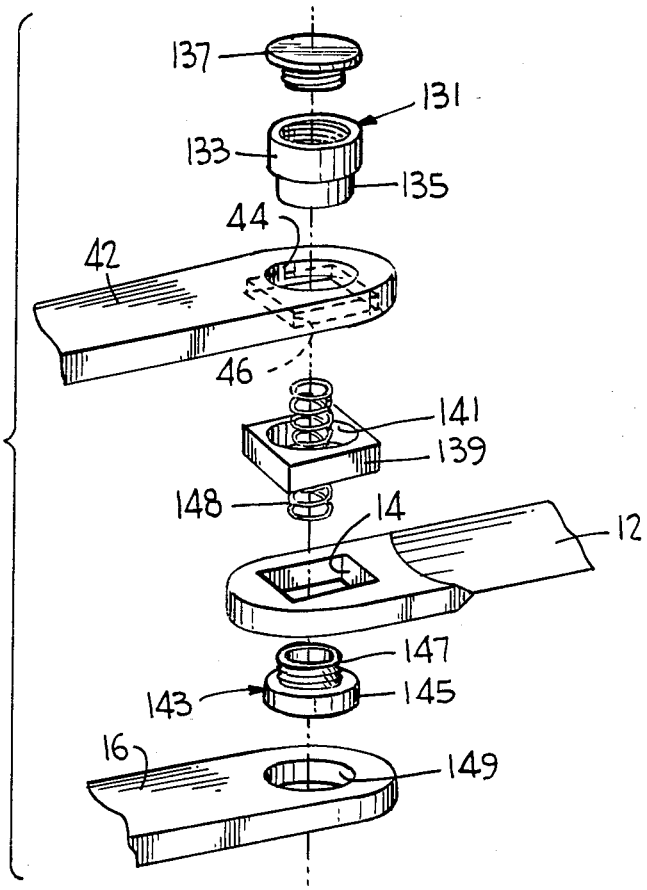
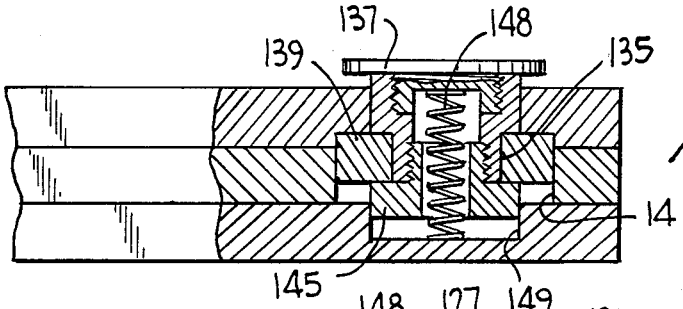
FIG. 7
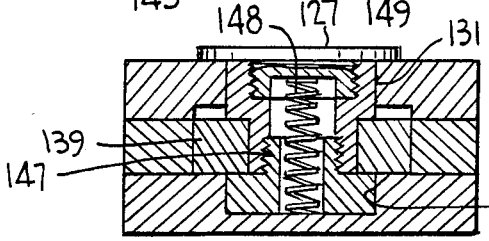
FIG. 8

KNIFE

BACKGROUND OF THE INVENTION

1. Field of the Invention

This invention relates to a knife, more particularly to a foldable kriife of the type generally recognized as hunting knives, pocket knifes, jack knives, etc.

2. Description of the Prior Art

The prior art is exemplified by U.S. Pat. Nos. 4,272,887, 4,170,061 and 3,942,249 and includes a folding knife having a locking or latching mechanism which latches the knife 1 in its closed position or in its open position. However, the prior art latching mechanisms utilize circular and/or arcuate surfaces and openings to obtain the latching function but such arrangements are subject to wear between the blade and the locking member, for instance a blade in the latch open position may be inadvertently subject to closing pressure without release of the latch and the prior art circular and/or arcuate surfaces do not present sufficient contact surface area between the blade and the latch, which places undue stress on the elements, causing wear and breakage. In addition, the prior art devices have only two locked positions, open or closed, so that when a person attempts to use a knife with the blade folded to an unlocked perpendicular position, the result is an unsafe condition inasmuch as the blade may rotate onto a person's hand with a resulting severe injury.

SUMMARY OF THE INVENTION

The present invention is summarized in a foldable knife including a pair of spaced handle strips, a blade having a mounting end disposed between adjacent ends of said strips, a non-circular non-arcuate multi-sided aperture in the mounting end of the blade, a circular opening in one of said strips disposed in axial alignment with such aperture, a non-circular non arcuate multi-sided recess in the one strip contiguous the circular opening and facing the mounting end of the blade, means in the other strip disposed in axial alignment with the circular opening and the aperture, and a latching mechanism arranged in the same axial alignment with the circular opening and the aperture, the latching mechanism including a non-circular non-arcuate multi-sided member being normally disposed partially in the recess and partially in the aperture whereby relative rotation between the one strip and the blade is precluded, a cup-shaped element having its rim fixed to the multi-sided member and having a wall protruding through the circular opening in the one strip, and a coil spring mounted in compression between the means in the other strip and the wall whereby the cup-shaped element and the multi-sided member are normally biased toward a latching position, said wall being depressed to displace the multi-sided member from the recess and into the aperture whereby the blade may be rotated from a latched closed position to a selected latched open position according to the number of alignable sides on the multi-sided member, said recess and said aperture.

OBJECTS OF THE INVENTION

It is an object of the present invention to construct a foldable knife in a simple and economical manner.

Another object of this invention is to lock a foldable knife in an intermediate position as well as in its open and closed positions, which intermediate position permits usage for special cutting operations.

The present invention has another object in that the latching mechanism of a foldable knife includes mating locking surfaces of substantial contact area which precludes accidental movement while the knife is in a locked position.

It is another object of this invention to lock a foldable knife in a selected position by means of a non-circular, non-arcuate, multi-sided latching member.

A further object of this invention is to construct a foldable knife which affords a safe operation in all positions of use.

Other objects and advantages of the present invention will become apparent from the following description taken in conjunction with the accompanying drawings.

BRIEF DESCRIPTION OF THE DRAWINGS

FIG. 1 is a side elevational view of a knife embodying the present invention with the blade shown in a closed position in solid lines and in two additional positions as represented by dashed lines;

FIG. 2 is an exploded perspective view of the knife of FIG. 1;

FIG. 3 is a cross sectional view on an enlarged scale taken generally reversed along the line 3—3 of FIG. 1 showing the latching mechanism in a locked position;

FIG. 4 is a partial cross sectional view similar to FIG. 3 but showing the latching mechanism in a released position;

FIG. 5 is a side elevational view similar to FIG. 1 but showing a modified form of the knife;

FIG. 6 is an exploded perspective view of the knife of FIG. 5;

FIG. 7 is a cross sectional view on an enlarged scale taken generally reversed along the line 7—7 of FIG. 5 showing the latching mechanism in a locked position but with the blade in a closed position and with parts broken away; and FIG. 8 is a partial cross sectional view similar to FIG. 7 but showing the latching mechanism in a released position.

DESCRIPTION OF THE PREFERRED EMBODIMENTS

As is illustrated in FIG. 1, the present invention is embodied in a knife, indicated generally at 10, including a single blade 12 pivotable from a locked closed position through 90° to a locked intermediate position and thence through another 90° to a locked open position. The blade 12 as shown in FIG. 2 has a mounting end with a non-circular, non-arcuate multi-sided aperture 14. In FIG. 2, the aperture 14 is shown as having a generally square shape or four sides; however, other non-circular polygonal shapes such as triangles, hexagons, etc. may be utilized to form the aperture 14 and may be selected to conform to particular knife requirements, such as size, weight, balance, use, etc.

The blade 12 pivots relative to a handle constructed by a first handle strip 16 having a circular opening 18 adjacent one end. A dead button 20 includes a cylindrical portion 22 one of which carries a square portion 24 with a central opening 26. The square portion 24 resembles a conventional nut and is welded or otherwise integrally formed onto the cylindrical portion 22; the opposite end of cylindrical portion 22 has internal threads (FIGS. 3 and 4) receiving a closure cap 28. An actuating button 30 includes a cylindrical portion 32 having a closed end and an opposite open end defined by a square portion 34 with a central opening 36. A second handle strip 42 had a circular opening 44 and a square shaped recess 46 surrounding a portion of the opening 44. In the event that the aperture 14 of the blade mount utilizes a non-circular polygonal shape other than the square as shown in FIG. 3, then a similarly complementary shape will be utilized on the elements 24, 34 and 44.

Assembly of the knife 10 is simply understood by reference to FIG. 3 wherein the actuating button 30 is inserted in the second handle strip 42 with the closed end of the cylindrical portion 32 protruding through the opening 44 and with the square portion 34 extending into the square shaped recess 46. Part of square portion 34 projects out of the recess 46 and is received in the square aperture 14 in the mounting end of the blade 12. Such square aperture 14 also receives the square portion 24 on the end of the cylindrical portion 22 of the dead button 20. Prior to the insertion of the square portion 24 in the square aperture 14, a coil spring 48 is mounted in compression between the interior wall of the closed end of cylindrical portion 32 and the interior wall defined by the open end of the cylindrical portion 22. The first handle strip is then positioned with its opening 18 surrounding the cylindrical portion 22. A retaining screw 28 is then threaded into the threaded opening of the cylindrical portion 22; as is apparent from FIGS. 3 and 4, the retaining screw 28 has a circumferential flange which is larger in diameter than the diameter of the opening 18 so as to abut the exterior of the first handle strip 16 and thus cooperate with the square portion 24 which abuts the interior of the first handle strip 16 whereby axial movement of the dead button 20 is precluded.

The first and second handle strips 16 and 42 are spaced from each other by means of a spacer 50 (FIG. 1); a plurality (4 in this instance) of screws 52 secure the two strips 16 and 42 and the spacer 50 together as a unit.

The closed position of the knife is represented by FIGS. 1 and 3 and this position is always locked because the square portion 34 of the actuating button 30 is biased into the square recess 46 which prevents the blade 12 from being rotated. In order to rotate the blade 12, the operator must first depress the actuating button 30 against the bias of the spring 48 as by thumb pressure, causing the square portion 34 to be displaced from the square recess 46 (see FIG. 4) into the square aperture 14 of the blade 12. Rotation of the blade 12 is now permitted since the two buttons 20 and 30 and the blade 12 all rotate as a unit. Only slight rotation of the blade 12 is necessary to displace the square portion 34 angularly from the square recess 46 whereby it is not necessary to keep the thumb pressure on the button 30 in order to continue the rotation of the blade 12; once the blade 12 is rotated 90 degrees the square portion 34 again aligns with the square recess 46 and is forced therein by the bias of the coil spring 48.

The 90 degree movement of the blade 12 places the knife in a locked intermediate position with the blade 12 being disposed perpendicularly relative to the handle strips 16 and 42. In this intermediate position, the knife 10 is locked for appropriate usages, e.g., ripping a paperboard carton, gutting a fish, and any task requiring a right-angled cutting blade.

If it is desired to move the blade from its locked intermediate position, the above described release operation is repeated for the latching mechanism comprising the two buttons 20 and 30, the coil spring 48 and the mounting for blade 12. Once released, the blade 12 may be rotated backward to its locked closed position or forward to its locked open position. After usage in the locked open position, the blade 12 may be returned to its locked closed position by first releasing the latching mechanism and then rotating the blade 12; during this return operation, the actuating button 30 may be depressed at the halfway point in order to bypass the locked intermediate position and rotate the blade 12 directly to the locked closed position.

The locked intermediate position of the knife according to the present invention offers the particular safety feature of permitting a cutting operation in this position and eliminating the chance of injury as occurs with the known prior art devices which collapse on the operator's finger or hand when used for a right-angled cutting operation.

It should also be noted that the knife 10 may be constructed so that both of a pair of actuating buttons must be depressed before rotation of the blade 12 between its various locked positions. In such an instance, the dead button 20 is replaced with an actuating button 30 and the first handle strip 16 is provided with a square recess similar to the recess 46 on the second handle strip 46.

As is shown in FIG. 2, the opening 14, the square portion 34 and the recess 46 conform to each other with the same geometric configuration. Thus, when the blade 12 of FIG. 1 is rotated from its closed position to the intermediate position through an angular dimension of 90°, the square portion 34 is rotated 90° relative to the recess 46. More particularly, one side of square portion 34 is rotated to the next adjacent side of the recess 46. Continued rotation of the blade 12 to its fully open position through another angular dimension of 90° displaces the square portion 34 an additional 90° relative to the recess 46; thus, the one side of square portion 34 is rotated to the subsequent side of the recess 46 or a total of 180° from the closed position. Closing of the blade is effected by a reverse displacement of the square portion so that the blade is returned the same 180° to the closed position.

As discussed above, different shapes may be utilized other than the square portion. For instance, the portion 34 and its corresponding parts may be designed that the blade travels 60° from a closed position to each subsequent position for a total of 180°, in which case, there would be two intermediate positions and a fully opened position totalling 4 locked positions 60° apart from each other. Of course, combinations of different sides may be utilized, such as a 90° side for the first open position, then two 45° sides for second and third open positions. It is now apparent that many multi-sided configurations may be utilized by varying the number of sides for the portion 34 and/or varying the angular degrees of rotation between the sides.

In the embodiment illustrated in FIGS. 5–8, the same general concept of the knife described above is also utilized with the difference being that only a single actuating button operates the latching mechanism. Identical reference numerals are utilized in FIGS. 5–8 for the identical parts described above in connection with FIGS. 1–4; accordingly, only the new parts will be described with reference numerals in the 100 series and only new function and operation will be described below. As is shown in FIG. 5, the actuating button, indicated generally at 130, includes a hollow cylindrical sleeve 131 having an upper large collar 133 and a lower smaller collar 135 with the bores of each being internally threaded. A closure cap 137 is threaded into the large bore 133 to close the same.

The sleeve 131 extends through the circular opening 44 in the handle strip 42 and a square shaped part 139 with a central opening 141 is mounted on the outer periphery of the small collar 135 for rotation thereon. The aperture 14 of the blade 12 is mounted on the square part 139 and is retained thereon by a hollow cylindrical bushing 143 which has a lower large collar 145 and an upper smaller collar 147 having external threads which are threaded into the bore threads of lower collar 135 so that the sleeve 131 and bushing 143 are connected with the square part 139 therebetween. The lower collar 145 of bushing 143 is slidingly received in a circular blind bore 149 provided in the handle strip 16. A coil spring 148 is mounted in compression between the bottom wall of the blind bore 149 and the undersurface of the closure cap 137 whereby the entire latching mechanism is biased as a unit toward the locking position shown in FIG. 7.

Depression of the actuating cap 137 compresses the coil spring 148 and displaces the square part 139 out of the recess 46 and completely into the square aperture 14 of the blade 12; as shown in FIG. 8, the bushing collar 145 is moved further into the blind bore 149.

Inasmuch as the present invention is subject to many variations, modifications and changes in detail, it is intended that all matter contained in the foregoing description or in the accompanying drawings shall be interpreted as illustrative and not in a limiting sense.

What is claimed is:

1. A knife comprising first and second handle strips disposed in parallel relation and spaced from each other along a transverse axis, a circular opening in one of said strips, and in axial alignment with said transverse axis, a blade having a mounting end disposed between adjacent end portions of said handle strips, a cylindrical actuator extending through said circular opening and being rotatable therein to define a pivotal axis for said blade, bore means in said other strip disposed in alignment with said pivotal axis and in facing relation to said actuator, latching means mounted between said actuator and said bore means in said other strip and including biasing means to bias said actuator to a latching position, said latching means locking said blade in selected locked positions of an open position, a closed position and an intermediate position therebetween generally perpendicular to the closed position, said latching means permitting release of said actuator for pivoting of said blade between its selected locked positions, wherein said bore means in said other strip includes a blind bore in said other strip and a bushing slidably disposed in said bore, wherein said biasing means comprises a coil spring mounted in compression between said blind bore and said actuator whereby said cylindrical actuator is normally biased to a locked position, wherein said cylindrical actuator includes a large hollow internally threaded collar and a small hollow internally threaded collar, a closure cap threaded into said large collar and engaging an exterior of said one strip to limit inward movement of said cylindrical actuator, and wherein the bushing has an upper collar threaded into the small hollow internally threaded collar.

2. A knife comprising a pair of spaced handle strips, a blade having a mounting end disposed between adjacent ends of said strips, a non-circular, non-arcuate multi-sided aperture having at least three sides in the mounting end of said blade, a circular opening in one of said strips disposed in axial alignment with said aperture, a non-circular, non-arcuate multi-sided recess having at least three sides in said one strip contiguous said circular opening and facing the mounting end of said blade, bore means in the other strip disposed in axial alignment with said circular opening and said aperture, and a latching mechanism arranged in the same axial alignment with said circular opening and said aperture, said latching mechanism including a non-circular, non-arcuate multi-sided member having at least three sides being normally disposed partially in said recess and partially in said aperture whereby relative rotation between said one strip and said blade is precluded, a cup-shaped element having its rim fixed to said multi-sided member and having a wall protruding through the circular opening in said one strip, and a coil spring mounted in compression between said bore means in the other strip and said wall whereby said cup-shaped element and said multi-sided member are normally biased toward a latching position, said wall being depressed to displace said multi-sided member from said recess and into said aperture whereby said blade may be rotated from a latched closed position to a selected latched open position according to the number of alignable sides on said multi-sided member, said recess and said aperture.

3. A knife as claimed in claim 2 wherein the number of alignable sides on each of said multi-sided member, said recess and said aperture is four.

4. A knife as claimed in claim 2 wherein said multi-sided member, said recess and said aperture are each square shaped.

5. A knife as claimed in claim 4 wherein said latching member latches said blade in a closed position, in an intermediate position generally 90° from the closed position and in an open position generally 180° from the closed position.

6. A knife comprising a pair of handle strips disposed in parallel relation and spaced from each other along a transverse axis, one of said strips having a circular opening through an end portion thereof, a non-circular polygonal shaped recess in said one strip being contiguous said circular opening and facing the other strip, a blade having a mounting end disposed between said strips adjacent said circular opening, a non-circular polygonal shaped aperture in the mounting end of said blade and being in register with said recess, a cylindrical actuating button extending through said circular opening, a non-circular polygonal shaped member fixed to said actuating button and being received in said polygonal shaped aperture and in said recess, said member having a round opening in axial alignment with said polygonal shaped aperture, bore means in the other strip disposed in facing relation to said polygonal shaped aperture, a coil spring extending through said polygonal shaped aperture and said round opening and being mounted in compression between said bore means in the other strip and said actuating button whereby said actuating button is normally biased outwardly of said one strip and said polygonal shaped member is normally biased into said recess to define a locked position for said blade wherein the blade is prevented from rotation about an axis defined by said cylindrical actuating button, said cylindrical actuating button being depressed against said coil spring to displace said polygonal shaped member out of said recess into said polygonal shaped aperture whereby said blade may be rotated relative to said handle strips, said polygonal shaped member, said recess and said polygonal shaped aperture having a conforming number of at least three sides whereby release of the actuating button causes the blade to automatically retract into a locked position as the polygonal shaped member is rotated from one polygonal side of said recess to an adjacent polygonal side thereof.

7. A knife as claimed in claim 6 wherein said polygonal shaped member, said recess and said aperture each have at least four sides.

8. A knife as claimed in claim 6 wherein said polygonal shaped member, said recess and said aperture are each square shaped.

9. A knife as claimed in claim 8 wherein said polygonal shaped member selectively locks said blade in a closed position, in an intermediate position generally 90° from the closed position, and in an open position generally 180° from the closed position.

10. A knife comprising a pair of handle strips disposed in parallel relation and spaced from each other along a transverse axis, one of said strips having a circular opening through an end portion thereof, a non-circular polygonal shaped recess in said on strip being contiquous said circular opening and facing the other strip, a blade having a mounting end disposed between said strips adjacent said circular opening, a non-circular polygonal shaped aperture in the mounting end of said blade and being in register with said recess, a cylindrical actuating button extending through said circular opening, a non-circular polygonal shaped member fixed to said actuating button and being received in said polygonal shaped aperture and in said recess, said member having a round opening in axial alignment with said polygonal shaped aperture, bore means in the other strip disposed in facing relation to said polygonal shaped aperture, a coil spring extending through said polygonal shaped aperture and said round opening and being mounted in compression between said bore means in the other strip and said actuating button whereby said actuating button is normally biased outwardly of said one strip and said polygonal shaped member is normally biased into said recess to define a locked position for said blade wherein the blade is prevented from rotation about an axis defined by said cylindrical actuating button, said cylindrical actuating button being depressed against said coil spring to displace said polygonal shaped member out of said recess into said polygonal shaped aperture whereby said blade may be rotated relative to said handle strips, said polygonal shaped member, said recess and said polygonal shaped aperture having a conforming number of sides whereby release of the actuating button causes the blade to automatically retract into a locked position as the polygonal shaped member is rotated from one polygonal side of said recess to an adjacent polygonal side thereof, and wherein said bore means in the other strip comprises a cylindrical button rotatably mounted in said other strip, an enlarged periphery on one end of said cylindrical button and disposed in said aperture to prevent outward axial movement of said cylindrical button, and a collar on the outside of said other strip extending through said other strip and being fastened to the other end of said cylindrical button to prevent inward axial movement of said cylindrical button.

11. A knife as claimed in claim 6 wherein said bore means in the other strip comprises an annular recess in the other strip in axial alignment with and facing said aperture.

* * * * *